United States Patent [19]

Dandl

[11] Patent Number: 5,003,225

[45] **Date of Patent: * Mar. 26, 1991**

[54] METHOD AND APPARATUS FOR PRODUCING INTENSE MICROWAVE PULSES

[75] Inventor: Raphael A. Dandl, San Marcos, Calif.

[73] Assignee: Applied Microwave Plasma Concepts, Inc., Carlsbad, Calif.

[ * ] Notice: The portion of the term of this patent subsequent to Mar. 22, 2005 has been disclaimed.

[21] Appl. No.: 293,307

[22] Filed: Jan. 4, 1989

[51] Int. Cl.[5] ..... H01J 7/24

[52] U.S. Cl. ..... 315/111.41; 315/111.71; 315/111.81; 313/231.31; 376/123

[58] Field of Search ..... 215/111.41, 111.71, 215/111.81, 111.91, 39, 4, 39.3; 313/231.31, 161; 330/4.3, 4.7; 376/121, 123, 132, 133

[56] References Cited

U.S. PATENT DOCUMENTS 4,292,124 9/1981 Fisch ..... 376/132
4,733,133 3/1988 Dandl ..... 315/111.41

OTHER PUBLICATIONS

Alexeff, "Oscillations Present in Plasma-Electron Heating by an Electron Beam", Phys. Rev. Lett., vol. 21, No. 6, Aug. 5, 1968, pp. 344–347.
Gladd, "The Whistler-Instability at Relativistic Energies", Phys. Fluids, vol. 26, No. 4, Apr. 1983, pp. 974–982.
Guest, "Amplication of Whistler Wave . . . Hot-Electron Plasmas", Phys. Fluids, vol. 31, No. 12, Dec. 1988, pp. 3690–3696.
Davidson et al, "Electromagnetic ion . . . in High-Beta Plasmas", The Phys. of Fluids, vol. 18, No. 8, Aug. 1975, pp. 1045–1050.
Eidson, "Coupling and Fast Waves in Electron Beam--Plasma System", Proc. of the National Electronics Conf., vol. XX, Oct. 19, 1964, pp. 84–87.
Santoru et al, "MM-Wave Generatron via Plasma Three-Wave Mixing", 28th Annual Meeting, Division of Plasma Physics, Nov. 3-7, 1986.

*Primary Examiner*—Eugene R. Laroche
*Assistant Examiner*—Seung Ham
*Attorney, Agent, or Firm*—Robert C. Hill; John A. Bucher

[57] ABSTRACT

A method and apparatus are disclosed for producing microwave radiation wherein a generally stable, high-beta, relativistic electron plasma is formed in a static magnetic field of a suitable enclosure either by an external microwave source or in situ within the plasma by means of at least one pair of steady-state interacting energetic electron beams, a convectively unstable wave then being created in the confined plasma either internally in an oscillator mode or externally in an amplifier mode by means of an external launcher for producing a pulse of relatively intense microwave radiation at a frequency near a local electron gyrofrequency. The above steps or functions are preferably sequentially repeated with sequential pulses of microwave radiation being withdrawn from the enclosure, focused by quasi-optical means and directed toward a target including electronic circuitry, so that the beam of sequential pulses is coupled into the electronic circuitry for developing substantial amounts of energy therein.

42 Claims, 4 Drawing Sheets

METHOD AND APPARATUS FOR PRODUCING INTENSE MICROWAVE PULSES

FIELD OF THE INVENTION

The present invention relates to a method and apparatus for producing microwave radiation and more particularly to such a method and apparatus for producing high-power, pulsed, microwave radiation within apparatus such as a pulsed microwave source including a suitable enclosure having a static magnetic field and a source of neutral gas to be ionized.

BACKGROUND OF THE INVENTION

Great amounts of effort have been expended in the prior art in connection with magnetic confinement of plasma for example in controlled thermonuclear fusion devices and the like. In this connection, the plasma comprises a highly ionized gas composed of a nearly equal number of positive and negative free charges (or positive ions and electrons). Because of the mutually coupled nature of electromagnetic fields within such a plasma and the motion of the plasma charges themselves, it has been well documented that the plasma can support unusual oscillations and wave motions, both stable and unstable. For example, stable and unstable wave motions in plasma are described by the McGraw-Hill Encyclopedia of Science & Technology, particularly in Volume 10, at pages 443–461 and Volume 14 at pages 501–507, both published by McGraw Hill Inc., 1977.

Further prior art work has been carried out in these areas having a closer relation to the method and apparatus of the present invention. A number of these prior art references are briefly described below.

1. Initially, work in connection with high-beta, hot-electron plasmas produced by electron-cyclotron heating was disclosed in an article by R.A. Dandl, H.O. Eason, P.H. Edmonds and A.C. England entitled "Resonance Effects on Electrons in Mirror-Contained Plasmas", *Nuclear Fusion*, 11 (1971).
2. Efficient generation of hot-electron plasmas by microwave power with multiple frequency components was discussed in an article by B.H. Quon, R.A. Dandl, W. DiVergilio, G.E. Guest, L.L. Lao, N.H. Lazar, T.K. Samec and R.F. Wuerker entitled "Impact of Multiple-Frequency Heating on the Formation and Control of Diamagnetic Electron Rings in an Axisymmetric Mirror", Phys. Fluids, 28 (5), May 1985.

3*a*. Work extending the results of a previous investigation of growing electromagnetic waves in a gyrotropic electron plasma to relativistic-electron energies was set forth in an article by R.N. Sudan entitled "Electromagnetic Instabilities in the Non-Thermal Relativistic Plasma", *Phys. Fluids*, 6, 57 (1963).

3*b*. Related work concerning a governing equation for whistler modes in the Elmo Bumpy Torus is set forth in an article by P.N. Guzdar and R. Marchand entitled "Whistler Instability in the Elmo Bumpy Torus", *Phys. Fluids*. 25 (4), Apr. 1982.

4. Production of a hot electron plasma in a magnetic-mirror field by high-power microwave discharges was disclosed in an article by H. Ikegami, H. Ikezi, M. Hosokawa, K. Takayama and F. Tanaka entitled "Microwave Burst at Triggered Instability in a Hot Electron Plasma", *Phys. Fluids*, 11 (5), May 1968.
5. The effects of a relativistic electron population on the temporal and spatial growth rates of the whistler instability were described in an article by N.T. Gladd entitled "The Whistler Instability at Relativistic Energies", *Phys. Fluids*, 26 (4), Apr. 1983.
6. Further work in the area of unstable electromagnetic waves similar to whistler modes was disclosed in an article entitled "Electromagnetic Ion Cyclotron Instability Driven By Ion Energy Anisotropy In High-Beta Plasmas", *Phys. Fluids*, 18, 1045 (1975).
7. Additional work concerning the ability of magnetically confined plasmas created and heated by electromagnetic fields near the electron gyrofrequency to support wave instability was disclosed in an article by G.E. Guest and D.J. Sigmar entitled "Stability of Microwave-Heated Plasmas", *Nuclear Fusion*, 11 (1971).
8. The theoretical rates of amplification of whistler waves propagating through hot-electron plasmas with anisotropic pressures was discussed in an article entitled "Amplification of Whistler waves Propagating Through Inhomogeneous Anisotropic Mirror Confined Hot-Electron Plasmas" by G.E. Guest and R.L. Miller in *Phys. Fluids*, 3690 (1988).
9. Both experimental and theoretical studies of hot-electron plasma generation using oppositely directed co-linear steady-state streams of energetic electrons interacting with a background plasma have been reported in numerous articles many of Which are cited in an article entitled "Oscillations Present in Plasma Electron Heating by an Electron Beam" by I. Alexess, G.E. Guest, D. Montgomery, R.V. Neidigh, and D.J. Rose in *Phys. Rev. Letters*, 344 (1968).
10. A theoretical analysis of the three-wave processes by which oppositely directed co-linear steady-state streams of energetic electrons interacting with a cold background plasma can produce electromagnetic waves suitable for generating hot-electron plasmas is presented for example in a book entitled *Plasma Astrophysics* by S.A. Kaplan and V.N. Tsytovich, published by Pergamon Press (Oxford) 1973.
11. Recent experiments and theories of the three-wave processes by which oppositely directed co-linear steady-state streams of energetic electrons interacting with a cold background plasma can produce electromagnetic waves at twice the upper hybrid frequency was reviewed in an article entitled "Experimental Observations of Non-Linearly Enhanced $2\Omega_{uh}$ Electromagnetic Radiation Excited by Steady-State Colliding Electron Beams" by T. Intrator, N. Hershkowitz and C. Chan. in *Phys. Fluids*, 527 (1984).

Rather than repeating substantial background information provided for example by the above references, each of the above references is incorporated herein as though set out in its entirety.

Generally, prior art references such as those noted above have dealt with the use of conventional sources of microwave energy to create and sustain magnetically confined plasmas for a variety of applications, together With an identification of the instabilities that can occur in such plasmas. However, there has generally been found to remain a need for a method and apparatus for generating microwave energy at high power levels substantially greater than those contemplated in the prior art while adapting the form of the high-power microwave energy for a number of different application.

U.S. Pat. No. 4,733,133 issued Mar. 22, 1988 to the inventor of this invention disclosed another method and apparatus for producing microwave radiation. The method and apparatus of that invention included certain features in common with the present invention, particularly in connection with extraction of a beam of microwave pulses from the chamber and direction toward a suitable target. Accordingly, that patent is incorporated herein by reference in order to provide a more complete understanding of the present invention.

SUMMARY OF THE INVENTION

It is therefore an object of the present invention to provide a method and apparatus for producing pulses of high-power microwave radiation within an enclosure having a magnetic field, at least one magnetic-mirror region and a source of neutral gas to be ionized, the method and apparatus comprising the development of a selected gas pressure within the enclosure, the generation of the magnetic field at a strength suitable for causing the generation and confinement of a hot-electron plasma, the introduction of at least two energetic electron beams arranged for interaction in a background plasma in order to generate substantial power levels of electromagnetic radiation at frequencies that are preferentially absorbed by the hot-electron plasma through cyclotron resonance at the hot-electron gyrofrequency or at a harmonic or overtone thereof heating by means of the interacting electron beams being continued in order to form a generally stable, high-beta, relativistic-electron plasma in the enclosure, a controlled wave instability then being developed in the plasma for producing a pulse of relatively intense microwave radiation at a frequency near a local electron gyrofrequency of the plasma or at a harmonic or overtone thereof. Preferably, the two steady-state interacting electron beams are formed in co-linear and opposed relation for interaction in a desired portion of the background plasma.

The method and apparatus of the present invention preferably contemplate such a combination wherein heating of the hot-electron plasma is carried out principally by collective interactions between one or more pairs of preferably co-linear and oppositely directed electron beams, the electron beams interacting With the background plasma to cause electron impact ionization of the ambient gas, and subsequently to generate electromagnetic radiation through a phenomenon known as a three-wave process in which pairs of spontaneously occurring electrostatic waves associated with the two electron beams interact to generate an electromagnetic wave at twice their frequency. This electromagnetic wave propagates radially outwardly through the plasma enclosure and, if the frequency is suitably adjusted, is preferentially absorbed by the hot-electron plasma that is magnetically confined in a static magnetic field, whereby the density and average energy of the hot-electrons are greatly enhanced.

The interacting electron beams referred to above provide the principal source of energy within at least one embodiment of the present invention and may be seen to result in situ generation of microwave energy at the point of interaction within the plasma. By contrast, the method and apparatus of U.S. Pat. No. 4,733,133 employed electron cyclotron heating produced solely by an external microwave source adapted for simultaneously producing multiple-frequency electron cyclotron heating and upper off-resonant heating using microwave power at frequencies above the electron gyrofrequency of the plasma for a similar purpose as the interacting electron beams of the present invention.

That technique of heating from an external microwave source, referred to in the above noted patent as "electron cyclotron heating" is also contemplated for optional use in the present invention together with the interacting electron beams as a supplemental heating source for optimizing operating conditions of the invention. In particular, the present invention contemplates the use of such electron cyclotron heating from an external microwave source, but at reduced power levels, preferably for producing multiple-frequency electron cyclotron heating in order to optimize performance of the present invention. For example, the external microwave power source may be employed to maintain the desired anisotropy of the hot-electron plasma and/or the density of the background plasma while carrying out the method of the present invention.

It is further contemplated within the method and apparatus of the present invention that the high-power microwave radiation formed within the enclosure be withdrawn from the enclosure through focusing means for concentrating sequential microwave pulses into a beam of focused radiation and directing the beam onto a remote target for concentrating energy therein. Preferably, the method and apparatus is adapted for directing the beam toward a target including electronic circuit means and conditioning the beam so that it is coupled into the electronic circuit means for developing substantial amounts of energy in the target.

In view of the preceding objects, the method and apparatus of the present invention include obvious potential for destroying or rendering inoperable electronic controls essential, for example, in offensive weapons systems. Suitable target applications of this type include boost and post-boost vehicles, collateral action on sensors and communications systems as well as satellite-based systems. The present invention contemplates a method and apparatus for effectively concentrating energy in such targets through the development of high-power microwave pulses With very rapid rise times and frequencies corresponding to characteristic operating frequencies of the target system.

Such operating frequencies are at very high levels and are expected to be at even higher levels in future generation devices. In prior art sources of microwave power, the maximum emitted power decreases rapidly with increasing frequency, principally because the size of a resonant structure decreases with increasing frequency while the power density increases with frequency to unacceptable levels. Thus, high-power microwave energy is now generally available only at frequencies that are well below the characteristic frequencies of many such systems. Under these conditions, coupling is primarily through apertures not intended for microwave propagation, with efficiency being consequently much less that achieved by direct coupling.

The importance of such applications and the limitations inherent in present microwave sources underline the urgent need for method and apparatus such as provided by the present invention for preferably producing pulsed; high-power microwave energy, with power levels above $10^{12}$ Watts for example at frequencies greater than eighteen gigahertz (GHz) and more preferably for generating short repetitive pulses of microwave power at levels in the range of about $10^{10}$–$10^{14}$ watts with frequencies above about 35 GHz.

Prior art microwave sources have also been found to exhibit a "resonant structure" problem in the form of unfavorable frequency dependence of peak power because the size of their interaction region is proportional to the wave length emitted. Moreover, electron energy or beams used in existing devices must generally operate at high voltages to ameliorate or overcome the space-charge effects that degrade source performance.

The present invention circumvents conventional resonant-structure problems and space-charged limitations by using microwave energy stored in a magnetically-confined, electrically neutral, relativistic-electron plasma, rather than an electron beam. The stored energy is built up over a period of seconds, for example, by beam-plasma interactions using moderate steady-state levels of DC power supplied in the form of one or more pairs of interacting and preferably co-linear, oppositely directed electron beams whose energy and current are chosen for efficient generation of magnetic-mirror confined hot-electron plasma. In normal operation, the stored energy is built up in a much shorter time, for example, in a fraction of a second. This technique of employing interacting electron beams relies upon a phenomenon referred to as the three-wave process, as also noted above.

Because of the temporal compression brought about by the sudden transformation of energy built up much more slowly, very high-power pulses can be produced repetitively from much lower power, DC electron beam sources operating at energies and current levels required or selected for the particular application. The peak power that can be achieved increases with frequency and with the volume of the magnetic-mirror configuration used to confine the relativistic-electron plasma. This permits very favorable scaling for applications of the type described above as described in greater detail below.

The method and apparatus of the invention employ a confining magnetic field forming an elongated, cylindrical, axisymmetric, magnetic-mirror region that is constricted at one or more axial positions inside its plane of reflection symmetry by additional, axisymmetric magnetic coils. Upon initiation of an operating cycle, the magnetic field preferably has the form of two or more co-linear magnetic mirrors, formed inside a conducting shell that serves as a vacuum chamber and as an enclosure for microwave power.

Gas pressure within the chamber is reduced to an appropriate level (about $10^{-5}$ Torr), the magnetic intensity is raised to a pre-selected level (about 2 Tesla) and the three-wave processing resulting from interaction of the two electron beams is continued for in situ generation of microwave energy in the chamber at a power level suitable for creating a relativistic-electron plasma with a beta value approaching unity. A suitable power level, for example, would be a fraction of one Watt/cm$^3$. Beta is the ratio of plasma pressure, p, to magnetic energy density, $B^2/2\mu_o$, where B is the magnetic field strength and $\mu_o$ is the magnetic permeability of free space. Beta is a dimensionless measure of the energy density stored in the plasma.

The beam-plasma interactions of the present invention are preferably designed to yield a stable, high-beta, hot-electron plasma in the form of two or more separate annular rings located in the co-linear mirror regions. The plasma is below the threshold for unstable growth of a class of electromagnetic waves propagating along field lines. such as whistlers, by virtue of their broad distribution of electrons in relativistic energies and the spatial variation of magnetic intensity, together with moderate pressure anisotropy, controlled by the heating process.

In a second phase of operation, auxiliary magnetic coils, for example, are energized to alter the spatial shape of the magnetic field into a single elongated magnetic mirror with a nearly uniform central region. This alteration is accomplished in a time that is much shorter than the hot-electron confinement time, resulting in adiabatic compression and merger of the separate annular rings of plasma formed in the first phase. This adiabatic compression increases both the pressure anisotropy and the magnetic field uniformity, bringing the hot-electron plasma to the threshold for unstable growth of the desired plasma waves.

In the method and apparatus of U.S. Pat. No. 4,733,133, a short pulse of microwave power was then injected to initiate an unstable wave, such as a whistler, and to create a denser cold plasma at the ends of the hot-electron plasma. That technique for producing a whistler wave instability in the plasma according to the above noted patent is referred to herein as operation in an oscillator mode in order to distinguish from a corresponding mode of operation described immediately below.

For operation in an amplifier mode according to the present invention, the wave to be amplified is introduced at one end of the enclosure or static magnetic field in the form of a whistler wave which propagates parallel to the magnetic lines of force and passes through the region of space occupied by the hot-electron plasma whereby the whistler wave can be greatly amplified if the wave frequency lies within a suitable chosen range. The amplified wave continues to propagate along the magnetic field lines and can be guided therealong into a quasi-optical structure described below for focusing the amplified wave into an outgoing beam of microwave power.

At the end of the high-power pulse, the auxiliary magnetic coils used for adiabatic compression are switched off and the magnetic field relaxes to its initial form. The operating cycle is then repeated to form sequential output pulses of microwave energy.

The present invention contemplates generation of a wave instability within the hot-electron plasma in either the oscillator mode or amplifier mode of operation as described above with power principally being supplied by the pairs of oppositely directed steady-state electron beams through the three-wave effect produced by interacting beam electrons as noted above. However, the present invention also contemplates the employment of the amplifier mode of operation for generating a wave instability either in combination with the three-wave effect referred to above or by the introduction of microwave energy into the plasma from an external microwave source in the manner disclosed by U.S. Pat. No. 4,733,133.

There are several important features of the present invention. In the initial phase, it is essential for efficient creation of stable, high-beta, hot-electron plasmas to use a suitably designed beam-plasma system for efficiently generating, by means of the three-wave process, an adequate level of electromagnetic wave power at frequencies near the relativistic-electron gyrofrequency or near a harmonic or overtone thereof in the hot-electron plasma or active medium to permit subsequent development of a whistler wave instability. As noted above, the three-wave process is preferably carried out by one or more pairs of preferably co-linear, oppositely directed steady-state electron beams caused to flow along the magnetic field lines through a background plasma that is generated by the electron beams through ionization of ambient gas.

If the density of this background plasma is maintained at a suitable level, for example, by proper adjustment of the ambient gas pressure and possibly through low-power electron cyclotron heating using an external source of microwave power, then the beam-plasma interaction will lead to the spontaneous generation of electromagnetic waves which can be preferentially absorbed by the hot-electron plasma. This preferential absorption takes place, for example, if the frequency of the spontaneously generated electromagnetic waves is near the second harmonic of the hot-electron gyrofrequency in the spatial region where the hot-electron plasma is confined.

The use of adiabatic compression of the plasma in an equilibrium condition to bring the plasma to the threshold for unstable growth of plasma waves is based on the identification of pressure anisotropy and magnetic field uniformity as the most effective control parameters for this mode. This identification is supported by a large number of theoretical studies of unstable electromagnetic waves (such as whistlers) as well as the closely related Alfven Ion Cyclotron mode. Adiabatic compression increases the perpendicular velocity of energetic electrons preferentially, thereby increasing the perpendicular pressure relative to the parallel pressure. The particular type of adiabatic compression used in the present invention has the added beneficial effect of bringing most of the plasma into a uniform magnetic field region and maximizing the fraction of the stored energy that is transformed into microwave power.

Finally, the use of a transient cold-plasma layer to reflect the growing whistlers in the oscillator mode of operation is analogous to Q-switching in conventional lasers. The objective is to further maximize the conversion of stored plasma energy to microwave power.

Additional objects and advantages of the invention will be apparent from the following description having reference to the accompanying drawings.

DESCRIPTION OF THE PREFERRED EMBODIMENT

Figure 1:
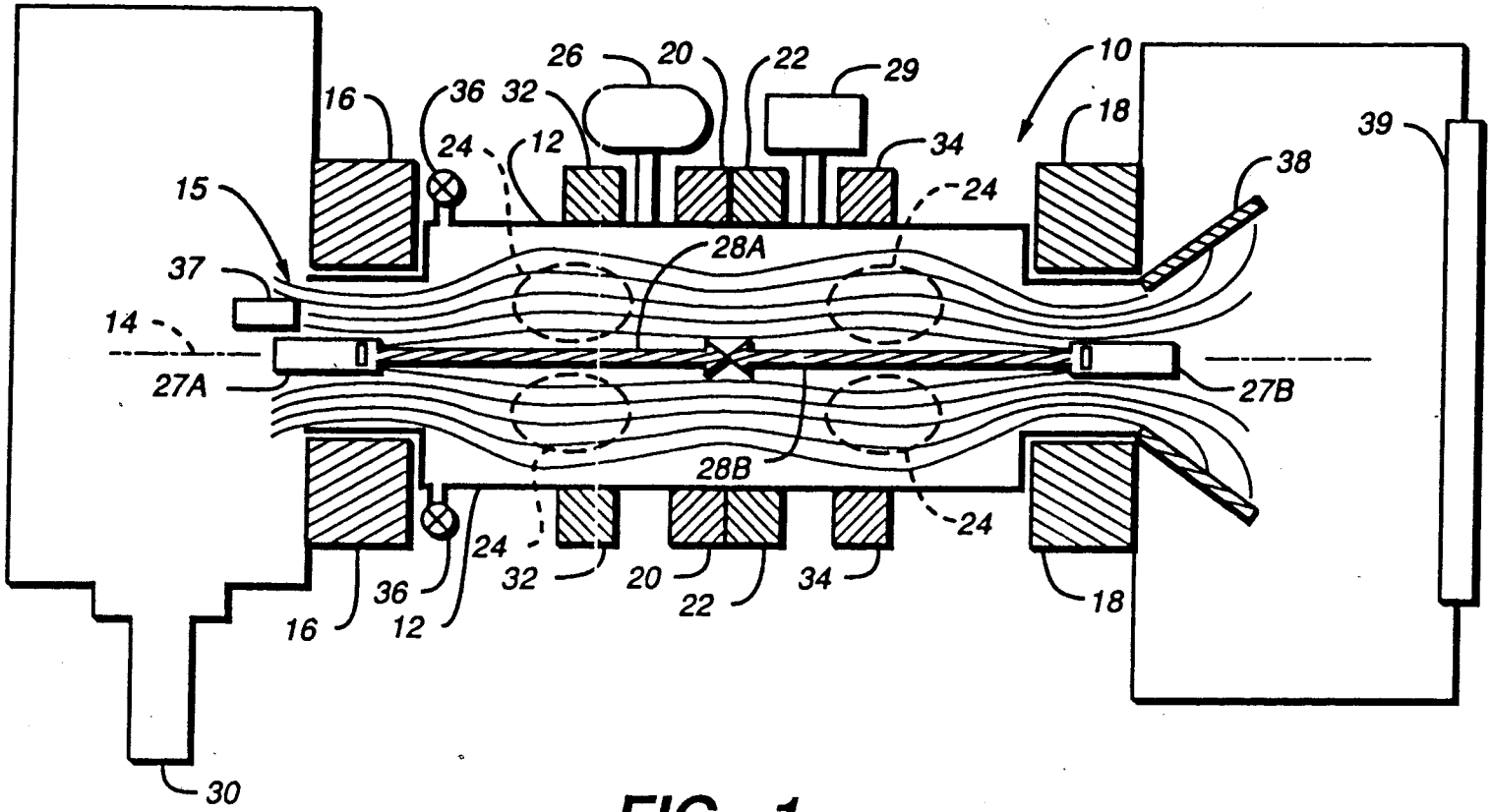
FIG. 1 is a generally schematic representation of a device comprising a magnetic mirror region enclosure for magnetically confining a plasma in accordance with the present invention.

As discussed above, the present invention provides a method and apparatus for efficiently storing substantial energy densities in high-beta, hot-electron plasmas, created and sustained by beam-plasma interactions in a suitable magnetic mirror device. A large fraction of this energy can be released in a short time by triggering suitable plasma instabilities such as unstable whistler waves driven by excess pressure anisotropy. Useful collective modes with frequencies at about the electron gyrofrequency and linear growth rates that are a significant fraction of the electron gyrofrequency can be stimulated either by proper design of a whistler Wave coupler-launcher, according to the present invention or by proper design of ECH components, and also disclosed in U.S. Pat. No. 4,733,133, and magnetic systems within the invention. Under suitable circumstances, it is anticipated that the method and apparatus of the invention are capable of generating relatively short pulses of microwave power, for example, at levels in the range from about $10^{10}$–$10^{14}$ Watts, at frequencies above 35 GHz, and with repetitive or sequential rates greater than one per second.

Thus, the method and apparatus of the invention are believed to have utility in a number of applications employing high-power microwave radiation developed in a magnetic mirror device and preferably transferred from the device through a focusing means to produce a pulsed beam of microwave radiation. This aspect of the invention makes possible the generation of high-power microwave beams which can be directed at remote target systems.

The present invention can thus provide a compact, rugged source of high power microwave and millimeter wave radiation for numerous applications in electronic warfare and in industrial applications of non-equilibrium plasma chemical processing. The source is broadly tunable, provides high power at high frequency and is readily scaled in size to provide super power pulses. Such applications are discussed for example in "Micro-Wave Heating Systems for Atmospheric Pressure Non-Equilibrium Plasmas" by G.E. Guest and R.A. Dandl in *Plasma Chemistry and Plasma Processing* (1988). This reference is also incorporated herein.

A growing number of applications for microwave and millimeter wave radiation present requirements that cannot be satisfactorily met with existing fundamental mode sources. These requirements include high power at high frequency with high efficiency, longer pulse lengths, tunability, and amplifier operation together with compact size, ruggedness and good reliability. An illustrative example in electronic warfare is the destruction of electronic controls, sensors, and communication systems. The most effective approach to coupling microwave power into the target utilizes super-power pulses with rapid rise times at the characteristic operating frequency of the target system. These frequencies are already high and expected to be higher in next-generation systems. Even now, high power is available only at frequencies below the characteristic frequencies of offensive weapons systems; and coupling must therefore be primarily through apertures not intended for microwave propagation with far lower efficiency than would be possible for direct coupling.

The capabilities of existing sources meeting these requirements are limited largely because the generation of power is based on the passage of high-energy electron beams through resonant structures. The maximum power emitted by such devices decreases rapidly with increasing frequency, $Pf^2$ constant, where P is the power emitted at frequency f. This limitation arises principally because the size of the resonant structure is proportional to the wavelength, $\lambda = c/f$; and increasing the frequency (decreasing the wavelength) increases the power density that must be handled by the resonant structure. The resulting power density limitation in conventional microwave sources is further exacerbated at high power by the need to increase the electron beam voltage to reduce space-charge effects which would otherwise degrade the source performance.

The present invention circumvents the conventional beam transit time, resonant structure, and space charge limitations by storing energy in a magnetic-mirror confined, electrically neutral, hot-electron plasma and periodically transforming a fraction of this stored energy into pulses of very high peak power. The transformation is mediated by a whistler wave preferably launched at one end of the mirror-confined plasma, propagating along the magnetic lines of force, amplified by the anisotropic hot-electron plasma, and subsequently collected and focused by quasi-optical elements at the opposite end of the plasma. The operating frequency of this amplifier is determined by the strength of the static magnetic field and can therefore be scaled to very high values. The gain is determined by the physical dimensions and the energy density of the mirror-confined plasma so that the output power can be increased by scaling in size. Because both the operating frequency and plasma energy density increase with increasing magnetic field strength, the peak power achieved in the proposed concept increases with frequency (as well as the volume of the magnetic mirror) to give highly favorable scaling properties for many applications. The resulting source can operate in either an amplifier or oscillator mode, as described in greater detail herein, have high efficiency and be implemented in a rugged, compact embodiment.

General approaches for bringing the plasma rapidly to the threshold for whistler amplification include control of the hot-electron temperature anisotropy and the magnetic field uniformity, and control of the background cold-plasma density and temperature.

The mirror-confined, hot-electron plasma that comprises the active medium responsible for amplification for oscillations of the whistler instability results from the collective interaction of two energetic electron streams interacting in a mirror-confined background plasma. Experimental and theoretical studies of hot-electron plasmas created by beam-plasma interactions confirm the presence in the plasma of many separate regions of high field strength which are individually coherent but mutually incoherent. Such a volume distribution of independent regions is especially useful for stochastic heating of a minority of the plasma electrons to create a mirror-confined hot-electron plasma. The energy stored in this plasma can, in turn, be used either to amplify incident whistler waves propagating along the lines of force (amplification mode) or as the source of spontaneous oscillation of whistler wave power (oscillation mode). In effect, energy is stored throughout the plasma volume by the beam-plasma interaction but transformed into a coherent, two-dimensional form by the unstable whistler wave.

Figure 2:
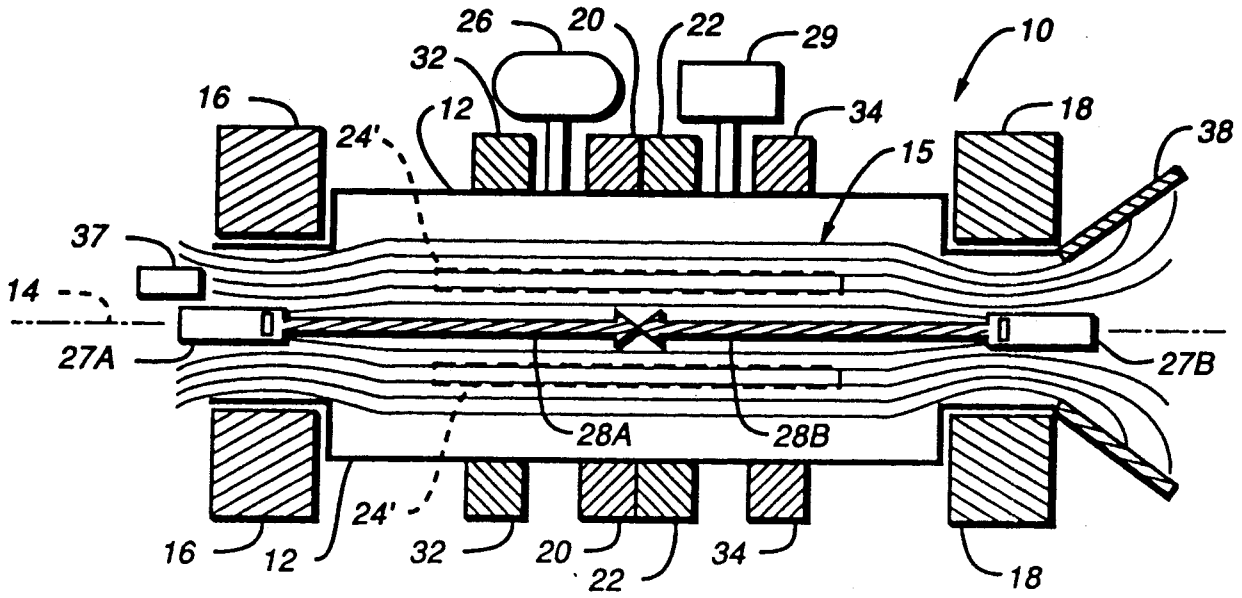
FIG. 2 is a view of the same device as illustrated in FIG. 1 but in a second operating stage described in greater detail below for introducing an unstable wave into the confined plasma.

Referring to the drawings and particularly to FIG. 1, a magnetic-mirror device of the type suitable for use within the present invention is generally indicated at 10. The device 10 includes a suitable elongated vacuum enclosure 12 having an axis of symmetry 14. Primary magnetic-mirror coils 16 and 18 are arranged in coaxial relation at opposite ends of the enclosure 12. Additional magnetic-mirror coils 20 and 22 are also arranged in coaxial relation with each other and with the primary coils 16 and !8. The additional coils 20 and 22 are arranged adjacent the longitudinal center of the enclosure 12 while being operable in a generally conventional fashion for forming two identical magnetic-mirror regions 24 as indicated in FIG. 2.

The device 10 also includes a source 26 of a suitable neutral gas for forming a plasma within the enclosure 12 and more particularly within the magnetic-mirror regions 24. The device 10 also includes opposed sources 27A and 27B arranged in opposition to each other along the axis 14 of the enclosure 12 for forming colinear, opposed energetic electron beams indicated at 28A and 28B.

Figure 4:
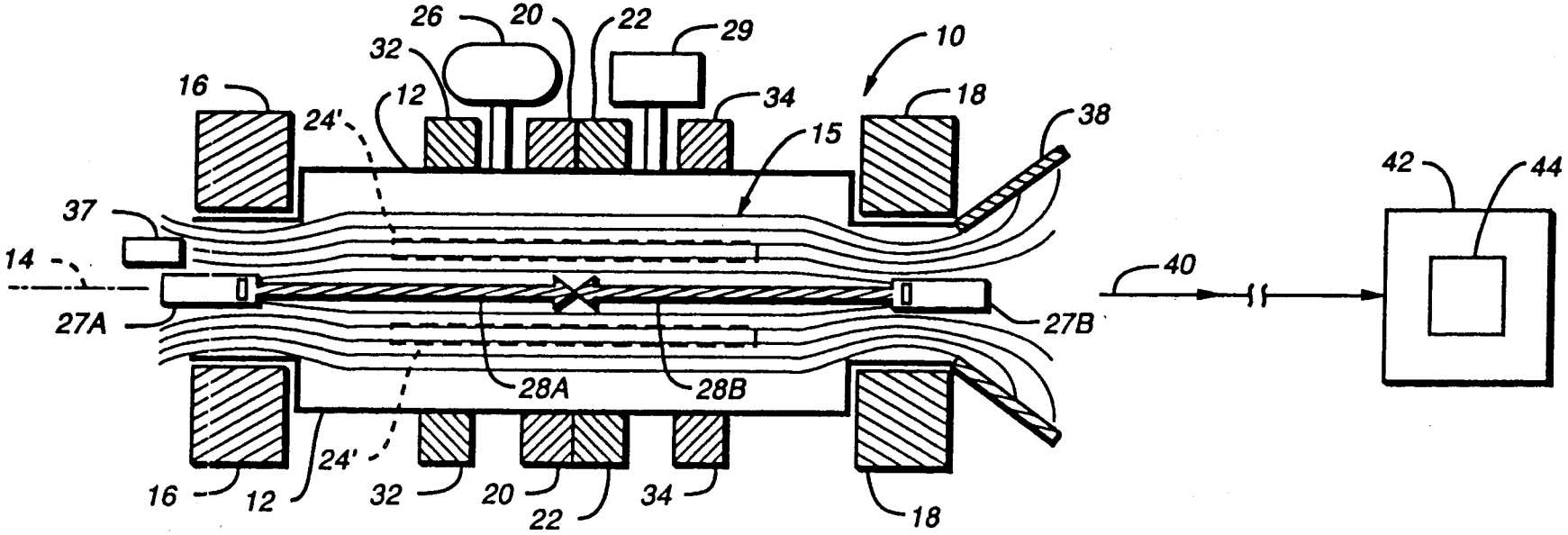
FIG. 4 is a schematic representation of the same device while illustrating additional components for causing a focused beam of microwave energy to be directed toward a remote target.

Several types of electron-beam forming techniques are well known in the prior art and discussed, for example, in an article entitled "Generation and Heating of Plasma by Beam-Plasma Interaction" by J. Jancarik, V. Kopecky, V. Pissl, J. Pohanka, J. Preinhaelter, M. Seidl, P. Sunka and J. Ullschmied presented at the Third Conference on Plasma Physics and Controlled Nuclear Fusion Research, Novosibirsk, 1–7 August 1968, International Atomic Energy Agency. That reference is incorporated herein to disclose structure of the type contemplated for each of the sources 27A and 27B. FIGS. 1, 2 and 4 show for clarity a case in which a single pair of oppositely directed co-linear steady-state electron beams is located on the axis of symmetry. An alternative embodiment is also possible in which pairs of electron beams are located around the periphery of the plasma so as to form a hot-electron plasma with density peaked on the axis of symmetry.

The device 10 also includes a supplemental microwave source 29 (corresponding to the primary source indicated at 28 in the above noted patent for developing both multiple-frequency electron cyclotron heating (MFECH) and upper off-resonant heating (UORH) within the enclosure 12 and also particularly within the magnetic-mirror regions 24). In the present invention, the microwave source 29 serves only an optional and supplemental feature for enhancing operation of the invention as noted above. Preferably, the supplemental microwave source 29 is adapted principally for upper off-resonant heating in the present invention. One or more vacuum pumps 30 are also provided for developing suitable evacuated pressures within the enclosure 12.

Auxiliary magnetic coils 32 and 34 are also arranged in coaxial relation with each other and with the primary coils 16, 18 and additional coils 20, 22. Furthermore, the auxiliary magnetic coils 32, 34 are respectively arranged intermediately between adjacent pairs of the primary coils 16, 18 and additional coils 20, 22 for operation in a manner described in greater detail below for selectively compressing magnetic lines of force 15 about the magnetic-mirror regions 24 in accordance with the present invention.

Fast-acting valves 36 are arranged preferably adjacent one end of the enclosure 12, as illustrated in FIG. 1, for injecting suitable times pulses of neutral gas into the enclosure also in accordance with the present invention for a purpose discussed in greater detail below.

A whistler wave coupler or launcher is illustrated at 37 generally adjacent the axis 14 of the enclosure 12 for introducing a whistler wave instability into the plasma confined Within the compartment for amplification in a manner as described above. The whistler wave coupler/launcher 37 is illustrated in greater detail in FIG. 3 and described immediately below.

Figure 3:
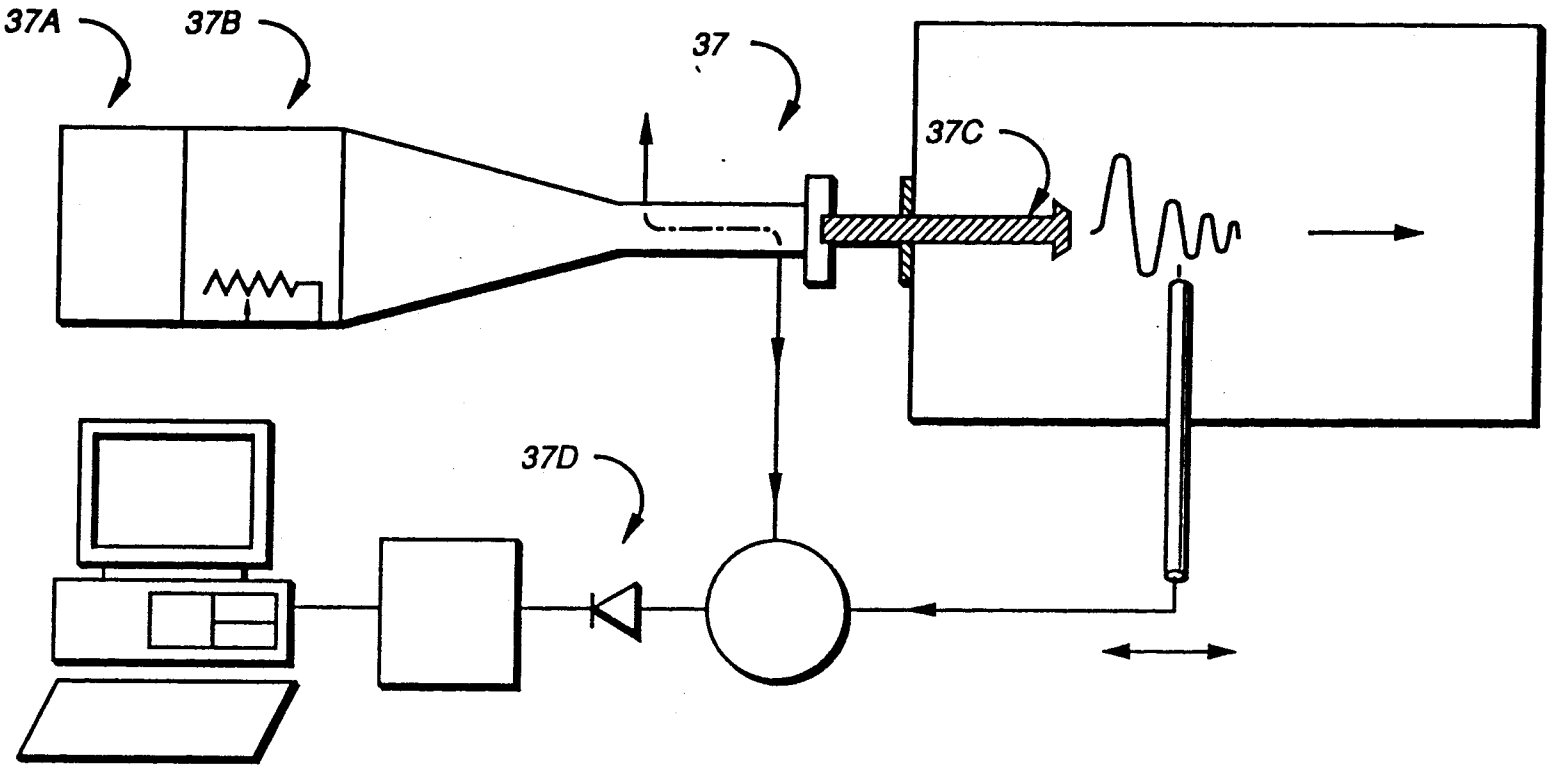
FIG. 3 is a generally schematic representation of a whistler launcher suitable for use in the device of FIGS. 1 and 2.

The whistler wave launcher illustrated in FIG. 3 consists of a suitable source 37A of microwave power to be amplified, coupled through a suitable impedance matching device 37B to a launch structure Which in the present case is a dielectric-loaded wave guide and microwave horn 37C. The remaining elements of FIG. 3, generally indicated at 37D, show the diagnostic equipment used to characterize the properties of the whistler wave launch.

Microwave energy developed within the device 10 is withdrawn by means of a quasi-optical structure 38 for producing a focused beam 40 of radiation which can be directed toward a remote target 42 through a suitable vacuum window 39 as illustrated in FIGS. 1 and 3. The remote target 42 is preferably of a type including electronic circuitry or an electronic subsystem 44, the method and apparatus of the invention being adapted as described in greater detail below for directly coupling microwave energy into the electronic subsystem 44 for developing substantial amounts of energy therein.

The apparatus of the present invention as described above and corresponding method, described in greater detail below, make possible a substantial advance in the development of microwave energy. In this regard, prior art devices for the production of high-power microwave energy exhibit a systematic reduction in power with increasing operating frequency because the size of the interaction region is proportional to the wave length. This severely limits the average and peak powers which can be generated. A notable exception to the scaling of interaction region size with frequency is the Free Electron Laser in which relativistic contraction maintains a constant interaction size. The efficiency decreases, however, as the frequency increases for all electron beam devices. Coupled with this is the inherent requirement for high voltage to minimize space charge effects in the electron beam which can significantly alter electron distribution and therefore performance of the system.

By contrast, the method and apparatus of the present invention circumvent conventional resonant structure problems and space charge limitations by storing microwave energy directly in a magnetically trapped, electrically neutral relativistic-electron plasma, thereby achieving the capability of producing very high power microwave pulses.

Prior art devices of the type referred to above also tend to provide peak output power at low frequencies where the dominant coupling mechanism to a target is achieved primarily by "back door coupling", that is, coupling through holes or apertures of the target in a manner not particularly suitable for microwave propagation. By contrast, the present invention permits the development of very high-power, fast rise-time signals which follow direct coupling paths to the target and particularly to the internal electronics for generating very substantial amounts of energy therein. In this application of the invention, the development of high-power, high-frequency devices capable of operating in the frequency band of target operating systems is critical, particularly because of the likelihood for successive generation devices to operate at still higher frequencies. Thus, the present invention makes possible the generation of substantial amounts of energy even at these increased frequencies.

In achieving the objective noted above, the method and apparatus of the present invention provide a unique high performance microwave source capable of operation in a parameter regime of substantially increased frequency and power levels. As noted above, the method and apparatus of the invention provide a novel means for efficiently storing energy by magnetic confinement of relativistic-electron plasma. The conversion of this stored energy by the triggering of a convectively unstable wave, for example a relativistic whistler instability, and the subsequent collection and focusing of the microwave radiation result in a system offering significant advantages over existing concepts.

The build-up and confinement of the relativistic-electron plasma occurs over a time scale of seconds. The transformation of this energy into a high peak power pulse occurs in less than one microsecond, for example, resulting in an effective temporal compression.

Successful operation of the invention indicates that the corresponding concept can be extended to yield dramatically high energy levels. For example, it is contemplated that energy in the range of between five and ten kilojoules can be achieved in the electron distribution by producing a hot-electron plasma with a density greater than $1\times10^{12}$ electrons/cubic centimeters ($E/cm^3$) with a temperature of about one million electron volts in a volume of seventy thousand cubic centimeters. The ability to produce this condition in a collision-free plasma where the limiting effects of space-charge are not present offers the possibility of scaling to drastically increased energy levels, offering a new conceptual approach to the production of high-power microwave energy.

To permit a better understanding of the potential of the present invention, a relatively brief discussion is set forth below concerning theory forming a part of the present invention. This theory indicates how the invention can be scaled to higher power and/or higher frequency operation.

A large base of empirical evidence has been developed through experimental research programs carried out largely in the 1960's. See, for example, J. Jancarik, et al., *Plasma Physics and Controlled Nuclear Fusion Research* (International Atomic Energy Agency, Vienna, Austria, 1968), CN-24/L-5; I.F. Karchenko, et al., Nucl. Fusion Supplement, Part 3, 1101 (1962); L.D. Smullin and W.D. Getty, Phys. Rev. Lett. 9, 3 (1962); I. Alexeff, et al., Phys. Rev. Lett., 10, 273 (1963); R.A. Demirkhavov, et al., *Plasma Physics and Controlled Nuclear Fusion Research* (IAEA, Vienna, 1966), Vol. II, 801 (1965); L.P. Zakatov, et al., Zh. Eksp. Teor, Fiz. 54 (1968) [ Sov. Phys. JETP].

These experiments demonstrated the formation of mirror-confined, hot-electron plasmas in which the average energy of the hot electrons reached values of 100 keV at densities such that $\Omega_{pe}{}^2/\Omega_{ce}{}^2>1$, where $\Omega_{pe}$ is the plasma frequency corresponding to the total electron density. Furthermore, many details of the high-frequency electric field and some of the underlying parametric dependences were explored in these experiments. See, for example, I. Alexeff, G.E. Guest, D.

Montgomery, R.V. Neidigh, and D.J. Rose, *Phys. Rev. Lett.* 21, 344 (1968) and references cited there.

Theoretical modeling of the experimental results was partially successful in identifying some of the dominant collective processes responsible for generation of large amplitude RF fields, as well as some features of the stochastic heating process responsible for creation of the hot-electron plasmas. See, for example. Thomas H. Stix, *Phys. Fluids* 7, 1960 (1964) and references cited there; D.D. Tyutov, Nucl. Fusion- 9, 297 (1969); for a more recent review, see A.V. Vedenov and D.D. Ryutov, *Reviews of Plasma Phys.* 6, 1 (1975) ed. by M.A. Leontovich, Consultants Bureau, N.Y.

The theoretical models generally resorted to the idealization of infinite homogeneous plasmas in uniform magnetic fields. Although some studies made an attempt to account for the finite radial extent of the electron beams, as well as the strong spatial variation of the magnetic-mirror fields used in these experiments. From this work, it is clear that spatial inhomogeneities of either the plasma density or the magnetic field strength can have major effects on the excitation of large amplitude RF fields as well as their absorption.

Optimum conditions for creating high-beta hotelectron plasmas using electron cyclotron heating have been greatly clarified as the result of experimental (R.A. Dandl, H.0. Eason, P.H. Edmonds, and A.C. England, *Nucl. Fusion* 11, 411 (1971)) and theoretical (G.E. Guest and R.L. Miller, "Formation of Stable, High-Beta, Relativistic-Electron Plasmas Using Electron Cyclotron Heating", to be published in Nuclear Fusion) studies of the ECH process in magnetic-mirror, EBT, and tokamak configurations. O-mode fields at overtones of the relativistic-electron gyrofrequency can be absorbed almost entirely by the hot-electrons, provided the plasma is contained in a cavity with a sufficiently high quality factor, Q. For the most effective two-stream heating of the hot-electron plasma, certain plasma and magnetic-field conditions yield large amplitude RF fields that can be preferentially absorbed by energetic electrons trapped in the magnetic-mirror region. A proposed geometry is shown schematically in FIGS. 1, 2 and 4.

The beam-plasma interaction region is expected to be strongest in regions where the background-plasma density is greatest and where the magnetic field is more nearly uniform than in cusp-like regions near the electron beam entrances. For optimal formation of a mirror-confined hot-electron plasma in such regions it is preferable to select plasma and beam parameters that will excite fields near the cyclotron harmonics of electrons mirror-trapped in that region. In fact, strongly preferential heating of relativistic electrons can be obtained if the FR electric fields are rich in the O-mode polarization and/or at overtones of the relativistic-electron gyrofrequency, if the cavity Q is high enough. The process most likely to provide this type of excitation is three-wave coupling leading to the generation of an obliquely propagating wave that can be absorbed by the mirror-trapped relativistic electrons.

The efficient accumulation of plasma energy stored in the mirror-confined, hot-electron component is made possible because of one or more stabilizing processes that raise the threshold for onset of instabilities during the accumulation phase. In order to obtain high-gain amplification of a particular plasma wave, such as the whistler waves mentioned above, it is necessary to deactivate in a controlled way the dominant stabilizing mechanisms. At least tWo general approaches to achieving this are possible. See A.V. Gaponov-Grekhov, V.M. Glagolev, and V. yu. Trakhtengerts, *Sov. Phys.* JETP 53, 1146 (1981).

An approach that has been proposed previously relies on adiabatic compression of the mirror-confined hot electrons. See U.S. Pat. No. 4,733,133. In this approach, the shape and strength of the confining magnetic field are rapidly altered in order to increase the hot-electron anisotropy and the magnetic-field uniformity in the central region of the trap. It is also possible in this approach to move through the critical density parameter, $\Omega_{pe}^2/\Omega^2 \sim > \Omega_{pe}^2 \sim 1$, so that the amplified wave couples effectively into outgoing electromagnetic radiation in vacuum, since $\Omega_{pe}^2/\Omega_{oe}^2 = nm/\epsilon_o B^2 \sim B^{-1}$ during adiabatic compression.

A second approach builds on techniques that were used in early experimental studies of whistler instabilities in which the parameters of the cold, background plasma were controlled so as to pass through a threshold value for the dominant stabilization mechanism. See H. Ikegami, et al., *Phys. Fluids* 11, 1061 (1968); and V.V. Alikaev, V.M. Glagolev, and S.A. Morozov, *Plasma Physics* 10, 753 (1968). A particularly simple implementation of this method used small pulses of microwave heating power applied at various times in the afterglow, that is, after the main heating pulse is terminated.

For some operating conditions, giant pulses of electromagnetic radiation have been spontaneously generated even without a supplemental ECH pulse. The key point is that unstable whistler waves can escape directly into vacuum if $\Omega_{pe}^2/\Omega^2 < 1$ and can be amplified by repeated reflections in a high-Q resonant structure. The hot-electron component must support a positive gain for each transit of the wave; but the non-linear action of the growing wave on the background plasma can lead to explosive growth and transformation of a large fraction of the hot-electron energy into radiation.

The theoretical discussion appearing in U.S. Pat. No. 4,733,133 is especially noted at this point to the extent that it assists in an understanding of this invention. See Column 8, lines 11–59 of U.S. Pat. No. 4,733,133.

The method of operation of the apparatus illustrated in FIGS. 1–4 is believed apparent from the preceding description of the apparatus and the theoretical discussion. However, operation is briefly described below in order to assure a complete understanding of the invention.

In operation, vacuum conditions are developed within the enclosure 12 by the vacuum pump 30 after which a suitable amount of an appropriate gas is introduced into the enclosure from the source 26.

The primary and additional magnetic-mirror coils 16, 18 and 20, 22 are operated for developing the magnetic-mirror regions 24 within the enclosure 12.

Microwave energy is preferably generated in situ within the hot-electron plasma confined by the static magnetic field within the enclosure 12. As noted above, in situ generation of microwave energy, in accordance with the present invention, is generated by two or more interacting pairs of energetic electron beams as discussed above for producing a desired three-wave effect. Preferably, the opposed energetic electron beams are selected and adjusted for producing upper off-resonant heating (UORH) within the enclosure and within the hot-electron plasma confined by the static magnetic region 24.

Electron heating by interaction of the opposed energetic electron beams within the plasma is also preferably continued in order to efficiently develop a stable, high-beta, relativistic-electron plasma within the static magnetic field or magnetic-mirror regions 24 within a short period to time, for example a fraction of a second.

Supplemental electron cyclotron heating as disclosed in the above noted patent by means of an external microwave source, indicated at 29 in FIGS. 1, 2 and 4, may be simultaneously carried out but at a reduced power level for further enhancing operating conditions of the method and device of the present invention.

A substantial fraction of the energy stored in the relativistic-electron plasma is transformed into a short pulse of intense microwave radiation at a frequency near the local electron gyrofrequency through the action of unstable coherent plasma waves. At a preselected time, the onset of suitable plasma oscillations is controlled by changing the plasma and magnetic field configuration to bring the plasma near to the threshold for spontaneous growth for a collective mode of oscillation. This technique, also described in U.S. Pat. No. 4,733,133, is referred to herein as the oscillator mode of operation.

By contrast, a whistler wave instability may also be externally introduced into the plasma according to the present invention in an amplifier mode of operation. In accordance with the preceding description, the whistler wave instability is introduced generally along the axis 14 by the coupler/launcher indicated at 37 with the whistler wave instability being allowed to amplify Within the plasma as described above.

The whistler mode is especially attractive for efficient conversion of stored energy to microwave fields because of the ability to control plasma parameters such as plasma pressure anisotropy and magnetic field homogeneity which governed the onset of instability conditions.

Referring to the drawings, the auxiliary magnetic coils 32 and 34 are energized in order to compress magnetic lines of force forming the magnetic-mirror regions 24 in order to form a field which is almost uniform as indicated at 24'. Annular rings of plasma within the regions 24 are compressed and coalesce to form an extended, hollow annulus of plasma in a nearly uniform magnetic field.

A short pulse of microwave power is supplied to the plasma in order to initiate instability, for example, the growth of unstable whistler waves. The build-up of the unstable whistler wave to a large amplitude is further enhanced by the simultaneous generation of a dense layer of cold plasma at the axial surface of the relativistic-electron plasma adjacent the primary coils 16. As noted above, this layer of cold plasma results from the injection of suitably timed pulses of neutral gas through the valve 36.

The rapidly growing plasma wave transforms a substantial fraction of energy stored in the plasma into coherent radiation at frequencies slightly below the electron gyrofrequency. The convectively amplified whistler waves propagate along the magnetic field lines of the regions 24 into the quasi-optical structure 38. The microwave energy in the form of the amplified whistler waves continues to be focused into a radiation beam pulse until the anisotropy and beta condition of the plasma are reduced below the threshold for growth. At that time, the auxiliary coils 32 and 34 are deactuated and the magnetic field is allowed to relax to its initial magnetic-mirror configuration as illustrated in the drawings.

Thereafter, the above noted operating cycle is sequentially repeated in order to produce sequential amplified whistler waves in the enclosure 12 forming sequential pulses in the beam 40 for transfer to the target 42 in the manner described above.

"Threshold for growth" defines plasma conditions such that more energy is transferred to the wave by the plasma than is absorbed from the wave by the plasma.

The term "local electron gyrofrequency" is further defined as eB/m, where e and m are the electrical charge and mass of the electron and B is the intensity of the magnetic field.

Thus, there have been described different embodiments of apparatus and a method of operation for those embodiments in accordance with the present invention. As noted above, the present invention contemplates use of hot-electron plasma generation by pairs of oppositely directed steady-state electron beams so a three-wave effect produced by the interacting energetic electron beams with a whistler wave instability being produced within the plasma either by an oscillator mode of operation or by an amplifier mode of operation. In addition, the present invention also particularly contemplates operation of the device and method in an amplifier mode employing an external coupler/launcher for the whistler wave with electron heating being carried out either by the three-wave process accomplished by the interacting electron beams or by electron cyclotron heating from an external microwave source as principally disclosed and claimed within U.S. Pat. No. 4,733,133. Numerous additional modifications and variations are possible in addition to those set forth above. Accordingly, the scope of the present invention is defined only by the following appended claims.

What is claimed is:

1. A method for producing pulses of high-power microwave radiation within an enclosure having a static magnetic field and a source of neutral gas to be ionized, comprising the steps of:

(a) developing a selected gas pressure within the enclosure;

(b) generating the magnetic field at a strength suitable for causing electron heating;

(c) producing high frequency microwave energy of a selected frequency and power level in the magnetic mirror region by forming at least one pair of steady-state, energetic electron beams arranged for interaction in a background plasma developed in the static magnetic field to generate a hot-electron plasma;

(d) continuing electron heating by means of the interacting electron beams to form a generally stable, high-beta, relativistic electron plasma in the enclosure; and then (e) inducing a convecutively unstable wave in the plasma for producing a pulse of relatively intense microwave radiation at a frequency near a local electron gyrofrequency.

2. The method of claim 1 wherein electron heating by the interacting electron beams is continued to approach threshold conditions for producing a three-wave effect.

3. The method of claim 2 wherein the electron beams are formed in co-linear opposition to each other.

4. The method of claim 1 wherein the hot-electron plasma of step (c) is confined in a mirror-like magnetic field having a folded-cusp configuration.

5. The method of claim 1 wherein the step of electron heating by the interacting beams is carried out for achieving upper off-resonant heating at frequencies above the electron gyrofrequency for preferentially heating the relativistic-electron plasma whereby both plasma stability and stored energy in the plasma are greatly enhanced.

6. The method of claim 1 wherein the step of inducing the convectively unstable wave in the plasma is carried out by an oscillator mode of operation.

7. The method of claim 1 wherein the step of inducing the convectively unstable Wave in the plasma is carried out by an amplifier mode of operation.

8. The method of claim 1 wherein the step of inducing the convectively unstable wave in the plasma is carried out for producing unstable whistler waves within the plasma.

9. The method of claim 8 wherein the step of inducing the convectively unstable wave in the plasma further comprises producing a transient cold-plasma layer in a peripheral portion of the magnetically confined plasma for reflecting growing whistler waves, thereby further maximizing conversion of stored plasma energy into microwave energy.

10. The method of claim 1 further comprising the step of withdrawing the relatively intense microwave pulse from the enclosure through focusing means for concentrating the pulse into a beam of focused radiation.

11. The method of claim 10 wherein the focusing means comprises a quasi-optical structure for receiving the microwave pulse from the enclosure and for transmitting the beam.

12. The method of claim 10 wherein the prior steps of the method are sequentially repeated for producing a sequential output series of pulses in the beam.

13. The method of claim 1 wherein the prior steps of the method are sequentially repeated for producing a sequential output series of microwave pulses.

14. The method of claim 13 further comprising the step of withdrawing the sequential output series of microwave pulses from the enclosure through focusing means for concentrating the pulse into a beam of focused radiation.

15. The method of claim 14 wherein the focusing means comprises a quasi-optical structure for receiving the microwave pulse from the enclosure and for transmitting the beam of focused radiation.

16. The method of claim 14 further comprising the step of directing the beam of focused radiation toward a target including electronic circuit means, the prior steps being selectively carried out for causing the beam to be directly coupled into the electronic circuit means for developing substantial amounts of energy therein.

17. The method of claim 1 wherein the step of inducing a convectively unstable wave is performed after electron heating by the interacting electron beams has been continued for placing the generally stable, high-beta, relativistic electron plasma in a condition above its threshold for growth, the resulting pulse of radiation continuing until the anisotropy and beta condition of the plasma are reduced below its threshold for growth.

18. The method of claim 1 further comprising the step of employing supplemental electron heating from an external microwave source for optimizing or enhancing conditions for producing the pulse of relatively intense microwave radiation.

19. Apparatus for producing pulses of high-power microwave radiation, comprising:

(a) an enclosure having a static magnetic field and a source of neutral gas to be ionized;

(b) means for developing a selected gas pressure within the enclosure;

(c) means for generating the magnetic field at a strength suitable for causing electron heating;

(d) means for introducing high frequency microwave energy of a selected frequency and power level into the enclosure by forming at least one pair of steady-state energetic electron beams arranged for interaction in a background plasma developed in the static magnetic field to generate a hot-electron plasma;

(e) the interacting electron beam means being adapted for continuing electron heating to form a generally stable, high-beta, relativistic-electron plasma in the enclosure; and (f) means for introducing a convectively unstable wave in the plasma for producing a pulse of relatively intense microwave radiation at a frequency near a local electron gyrofrequency.

20. The apparatus of claim 19 wherein the interacting electron beam means are adapted for continued electron heating to approach threshold conditions for producing a three-wave effect.

21. The apparatus of claim 19 wherein the interacting electron beam means are arranged for formation of the pairs of electron beams in co-linear opposition to each other.

22. The apparatus of claim 19 wherein the means for introducing the convectively unstable wave comprise means for carrying out an oscillator mode of operation.

23. The apparatus of claim 19 wherein the means for introducing the convectively unstable wave comprise means for carrying out an amplifier mode of operation.

24. The apparatus of claim 23 wherein the means for carrying out an amplifier mode of operation comprise an external launcher for introducing a whistler wave instability of selected frequency into the hot-electron plasma.

25. The apparatus of claim 19 further comprising focusing means for withdrawing the relatively intense microWave pulse from the enclosure and concentrating the pulse into a beam of focused radiation.

26. The apparatus of claim 25 further comprising means for sequentially repeating operation of the apparatus for producing a sequential output series of pulses in the focused beam.

27. The apparatus of claim 26 further adapted for directing the beam of focused radiation toward a target including electronic circuit means, the prior steps being selectively carried out for causing the beam to be directly coupled into the electronic circuit means for developing substantial amounts of energy therein.

28. The apparatus of claim 19 further comprising means for sequentially repeating operation of the apparatus for producing a sequential output series of pulses.

29. A method for producing pulses of high-power microwave radiation within an enclosure having a static magnetic field and a source of neutral gas to be ionized, comprising the steps of:

(a) developing a selected gas pressure within the enclsoure;

(b) generating the magnetic field at a strength suitable for causing electron heating;

(c) forming high frequency microwave energy of a selected frequency and power level in the static magnetic field;

(d) continuing electron heating to form a generally stable, high-beta, relativistic electron plasma in a hot-electron plasma confined int he static magnetic field; and the (e) inducing a convectively unstable wave in the plasma for producing a pulse of relatively intense microwve radiation at a frequency near a local electron gyrofrequency in an amplifier mode of operation.

30. The method of claim 29 wherein the step of inducing the convectively unstable wave in an amplifier mode of operation is carried out by means of an external launcher for introducing a whistler wave instability of selected frequency into the hot-electron plasma.

31. The method of claim 30 wherein the step of forming high frequency microwave energy int he static magnetic field is performed by employing an external microwave source for introducing the high frequency microwave energy thereinto.

32. The method of claim 30 wherein the step of forming high frequency microwave energy in the static magnetic field is performed by employing interacting energetic electron beams for in situ generation, by means of a three-wave effect, of the high frequency microwave energy in a hot-electron plasma confined in the static mangetic field.

33. The method of claim 30 further comprising the step of withdrawing the relatively intense microwave pulse from the enclosure through focusing means for concentrating the pulse into a beam of focused radiation.

34. The method of claim 33 wherein the prior steps of the method are sequentially repeated for producing a sequential output series of pulses in the beam.

35. The method of claim 34 further comprising the step of directing the beam of focused radiation toward a target including electronic circuit means, the prior steps being selectively carried out for causing the beam to be directly coupled into the electronic circuit means for developing substantial amounts of energy therein.

36. Apparatus for producing pulses of high-power microwave radiation, comprising:

(a) an enclosure having a static magnetic field and a source of neutral gas to be ionized;

(b) means for developing a selected gas pressure within the enclosure;

(c) means for generating the magnetic field at a strength suitable for causing electron heating;

(d) means for forming high frequency microwave energy of a selected frequency and power level into the static magnetic field;

(e) means for carrying out electron heating in a plasma background confined by the static magnetic field to form a generally stable, high-beta, relativistic-electron plasma in the enclosure: and (f) external amplification means for introducing a convectively unstable wave in the plasma for producing a pulse of relatively intense microwave radiation at a frequency near a local electron gyrofrequency.

37. The apparatus of claim 36 wherein the external amplification means comprises an external launcher for introducing a whistler wave instability of selected frequency into the hot-electron plasma.

38. The apparatus of claim 37 wherein the means for forming the high frequency microwave energy in the static magnetic field comprises an external microwave source for introducing the high frequency microwave energy thereinto.

39. The apparatus of claim 37 wherein the means for forming the high frequency microwave energy in the static magnetic field comprises means for forming interacting energetic electron beams for in situ generation, by means of a three-wave effect, of the high frequency microwave energy in a hot-electron plasma confined in the static magnetic field.

40. The apparatus of claim 37 further comprising focusing means for withdrawing the relatively intense microwave pulse from the enclosure and concentrating the pulse into a beam of focused radiation.

41. The apparatus of claim 40 further comprising means for sequentially repeating the functions of the apparatus for producing a sequential series of output pulses in the beam.

42. The apparatus of claim 41 wherein the apparatus is adapted for directing the beam of focused radiation toward a target including electronic circuit means, the prior steps being selectively carried out for causing the beam to be directly coupled into the electronic circuit means for developing substantial amounts of energy therein.

* * * * *